United States Patent [19]

Rouleau et al.

[11] Patent Number: 5,039,079

[45] Date of Patent: Aug. 13, 1991

[54] PROCESS AND APPARATUS FOR SUPERIMPOSING AT LEAST TWO FLEXIBLE LAYERS IN PARTICULAR THE FRONT AND REAR PANELS OF AN ARTICLE SUCH AS A SLIP IN THE TEXTILE AND KNITTED GOODS INDUSTRY

[76] Inventors: Patrick Rouleau, 52, Boulevard Carnot; Alain Rouleau, 3, rue Espinasse, both of 31000 Toulouse; Jean-Pierre Touret, Route de Menville, Brext - 31530 Levignac, all of France

[21] Appl. No.: 371,521

[22] Filed: Jun. 26, 1989

[30] Foreign Application Priority Data

Jun. 27, 1988 [FR] France ..... 88 08713

[51] Int. Cl.[5] ..... B65H 5/26

[52] U.S. Cl. ..... 271/9; 271/14; 271/18.3; 112/121.15; 112/121.29; 112/303; 112/320; 112/148

[58] Field of Search ..... 271/1, 9, 10, 14, 18.3, 271/175, 4, 267, 85, 306, 207; 112/306, 320, 303, 121.15, 262.3, 121.29, 121.12, 121.14, 303, 148, 18, 405; 270/58

[56] References Cited

U.S. PATENT DOCUMENTS

| | | | |
|---|---|---|---|
| 3,604,701 | 9/1971 | Hawley | 112/121.29 X |
| 4,451,191 | 5/1984 | Torre | 271/9 X |
| 4,633,604 | 1/1987 | Adamson et al. | 112/306 X |
| 4,635,918 | 1/1987 | Rouleau et al. | 271/18.3 |
| 4,763,890 | 8/1988 | Zimmerman et al. | 271/9 X |
| 4,781,369 | 11/1988 | Mathias | 271/84 X |
| 4,822,020 | 4/1989 | Rouleau et al. | 271/18.3 |

FOREIGN PATENT DOCUMENTS 8806752 8/1988 France .

*Primary Examiner*—David H. Bollinger
*Attorney, Agent, or Firm*—Harold H. Dutton, Jr.

[57] ABSTRACT

The invention relates to a process and an apparatus for superimposing at least two flexible sheets, in particular a back panel and a front panel of an article such as a slip. The process comprises forming a stack of each type of sheets and arranging said stacks on a plate (1), then for each of these stacks: gripping at least one sheet by means of a gripping assembly (12, 14) arranged above the plate (1) and relatively displacing said plate and said gripping assembly between a rest position and a sheet gripping position, displacing the gripping assembly (12, 14) so as to bring it above a deposit member (15) and actuating the assembly so as to release the sheet and spread it on the deposit member, returning the gripping assembly (12, 14) above the plate (1) and causing the plate to rotate a portion of a revolution to position a second stack directly below the gripping assembly.

12 Claims, 8 Drawing Sheets

PROCESS AND APPARATUS FOR SUPERIMPOSING AT LEAST TWO FLEXIBLE LAYERS IN PARTICULAR THE FRONT AND REAR PANELS OF AN ARTICLE SUCH AS A SLIP IN THE TEXTILE AND KNITTED GOODS INDUSTRY

This invention relates to a process for superimposing at least two flexible layers, particularly a rear and front panel of an article such as a slip in the textile and knitted goods industry. The invention also relates to an apparatus for superimposing at least two flexible layers for carrying out this process.

BACKGROUND AND OBJECTS OF THE INVENTION

At the present time, the conventional manufacture of slips requires three preliminary work stations for the preparation of the slips. The first station comprises bringing the edge seams of the two layers of fabric, front to back. The second station comprises sewing the gusset along its median axis on the front panel. The third station comprises finally spreading out the gusset on the front panel, from one side to the other of the median seam, and fixing it at two points in order to keep it in this position for the following operations.

The present invention has as its primary object to substitute for the assembly of these preparatory stations a production in a single pass at a unique work station.

DESCRIPTION OF THE INVENTION

To this effect, the invention provides a process for superimposing at least two flexible sheets, in particular the front and rear panel of an article such as a slip, in the textile and knitted goods industry, and is characterized in that it comprises forming a stack of each type of layer or sheet, and placing these stacks on a plate, then for each of these stacks:

- gripping at least one layer from a stack by means of a gripping assembly arranged above the plate, relatively displacing the plates and the gripping assembly between a rest position, where they are separated by a predetermined distance, and a sheet gripping position,
- subjecting the gripping assembly to a translation movement so as to move it above a deposit member and actuating the assembly in such a manner as to release the layer and spread it onto the deposit member,
- again bringing the gripping assembly above the plate and causing the plate to rotate a portion of a revolution so as to position a second stack directly below the gripping assembly.

Thus, when each cycle is carried out, corresponding to a number of reciprocations of the gripping assembly equivalent to the number of stacks arranged on the plate, this process permits picking up and superimposing on the deposit member one layer from each stack.

Preferably, the layers are arranged astride a deposit member which comprises a vertical plate having with an upper horizontal deposit edge.

Further, the layers are preferably arranged, initially on two deposit bars arranged on opposite sides of the deposit plate, parallel to the upper edge of the latter and movable between a position slightly elevated with respect to the upper edge and a lower retracted position.

The deposition of each layer is carried out, preliminarily, onto the two deposit bars in such a manner that that layer does not displace the lower, previously deposited layers, when it is brought above the deposit plate. These deposit bars are then retracted to allow the particular layer to fall astride the deposit plate.

Additionally, according to one preferred embodiment, the transported layers are restrained by aspiration means in the vicinity and ahead of the deposit member in such a manner as to suppress any risk of waves in these layers.

In the case where the process is carried out to superimpose a rear panel, a front panel and a gusset of a slip, advantageously stacks of gusset panels and front panels are arranged on the plate with a centrifugal displacement with respect to a stack of back panels so that the gripping assembly seizes each front and each gusset along a line near a longitudinal extremity of the latter and each back along an intermediate line between its extremities.

Thus, each front panel and each gusset panel is laid astride the deposit plate, without a longitudinal fold. On the contrary each back is folded longitudinally when placed on the deposit plate.

Further, the deposit member may advantageously be subjected to a translational movement toward or away from the plate in order to adjust the position of the deposit member and to obtain a superimposition of the layers with one of their longitudinal edges aligned.

The three layers are thus deposited in a superimposed manner in an appropriate position to permit the operator to carry out on the same sewing machine, first the axial sewing of the gusset, then the two sewing steps of the side. During these operations, the longitudinal folding of the back avoids the situation in which the back would be sewn when the axial sewing of the gusset is carried out.

The invention also relates to an apparatus for superimposing at least two flexible layers, in particular a front panel and a rear panel of an article such as a slip, in the textile and knitted goods industry, characterized in that it comprises:

- a stack plate provided with means for holding and positioning at least two stacks of sheets arranged thereon,
- a deposit member for the sheets, spaced a distance from the plate,
- a gripping assembly associated with actuating means and adapted to grip at least one sheet from a stack, and to release it on command,
- means for translationally displacing the gripping assembly and adapted to move it between a rest position where the gripping assembly is positioned above the plate, and a deposit position where it is positioned directly above the deposit member,
- means for relatively displacing the plate and the gripping assembly and adapted to displace them between a position corresponding to the rest position of the gripping assembly and a sheet gripping position,
- means for rotating the plate and adapted to successively position the stacks of sheets on the plate directly below the gripping assembly when in its rest position.

DESCRIPTION OF THE DRAWINGS

Other characteristics, objects and advantages of the invention will become apparent from the detailed description which follows with reference to the annexed drawings which show by way of non-limiting example, one preferred embodiment. In these drawings which form an integral part of the present description.

DETAILED DESCRIPTION OF PREFERRED EMBODIMENTS

Figure 1:
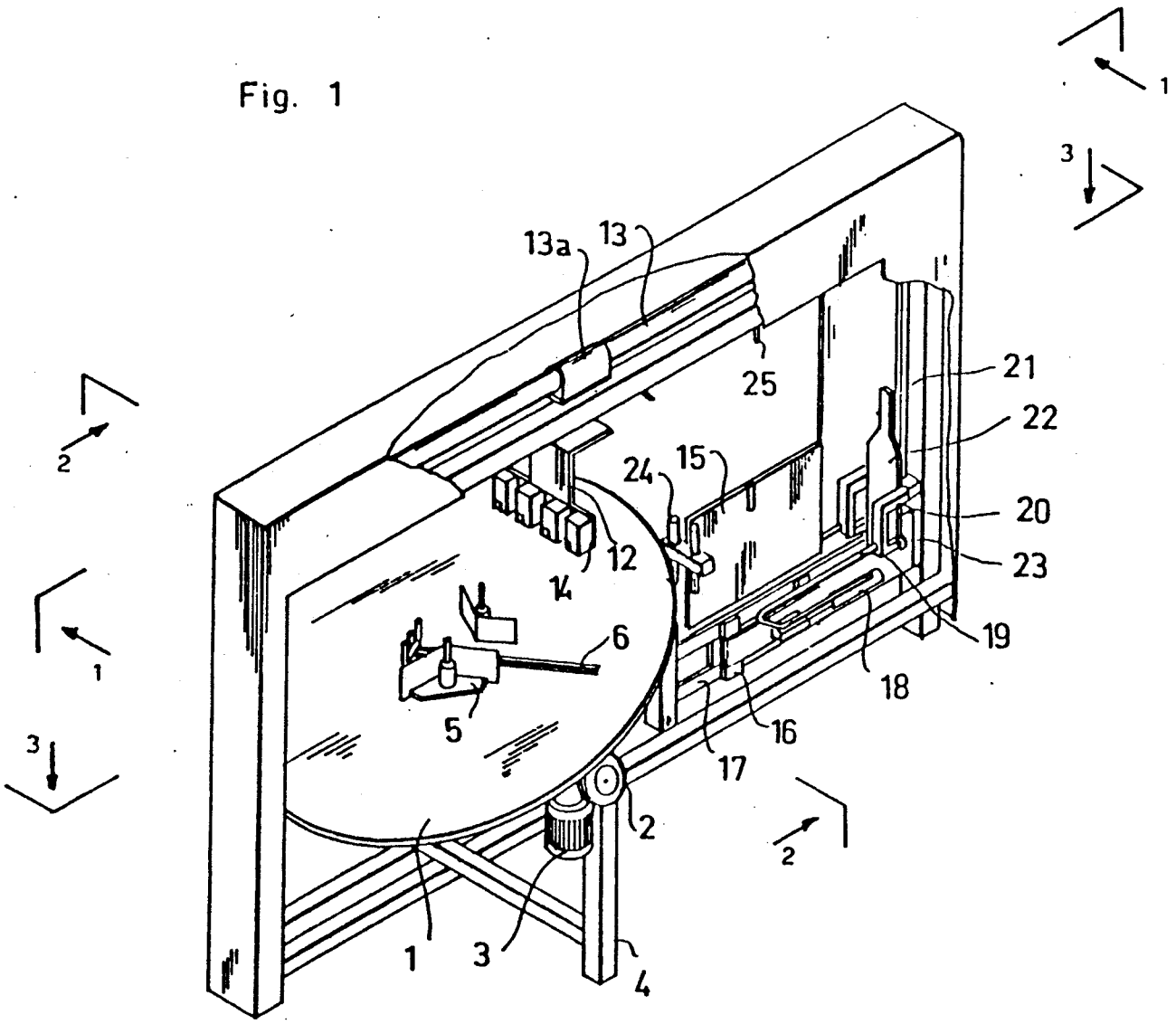
FIG. 1 is a perspective view, with one portion of the covering removed for clarity, showing an apparatus according to the invention.
Figure 2:
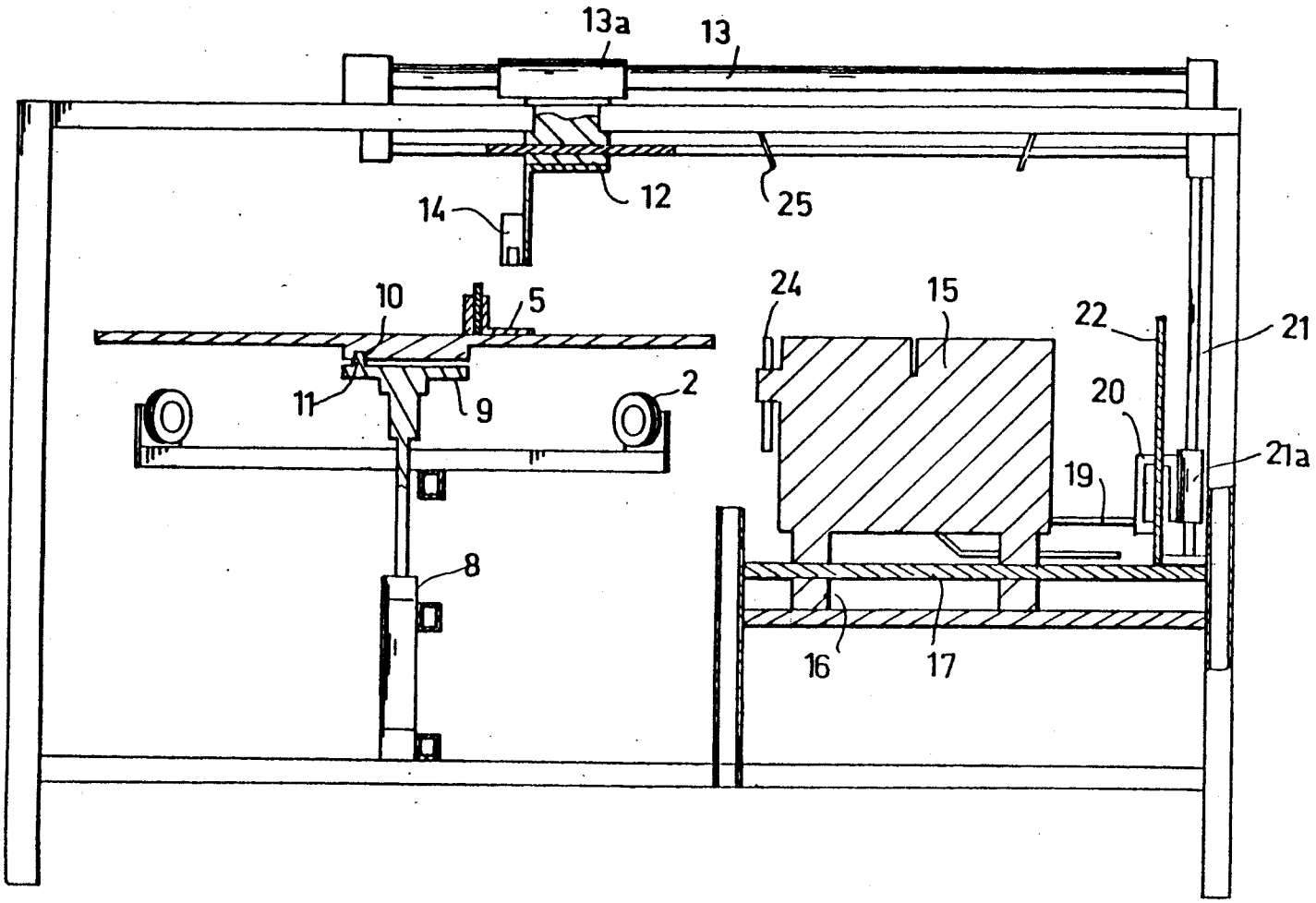
FIG. 2 is a longitudinal cross-sectional view along a vertical plane A—A of FIG. 1 and view in the direction of the arrows.
Figure 3:
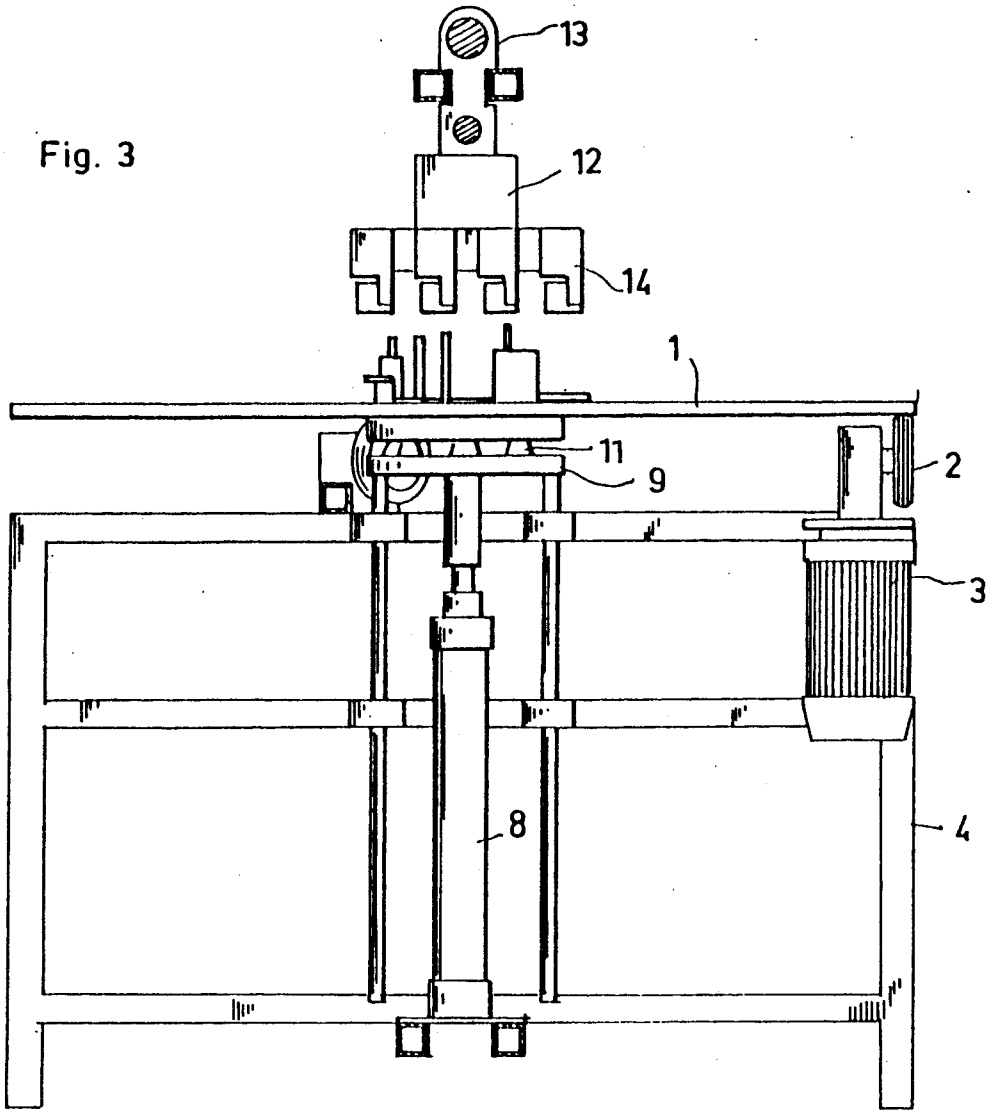
FIG. 3 is a transverse cross-sectional view along a vertical plane B—B of FIG. 1 and viewed in the direction of the arrows.
Figure 4:
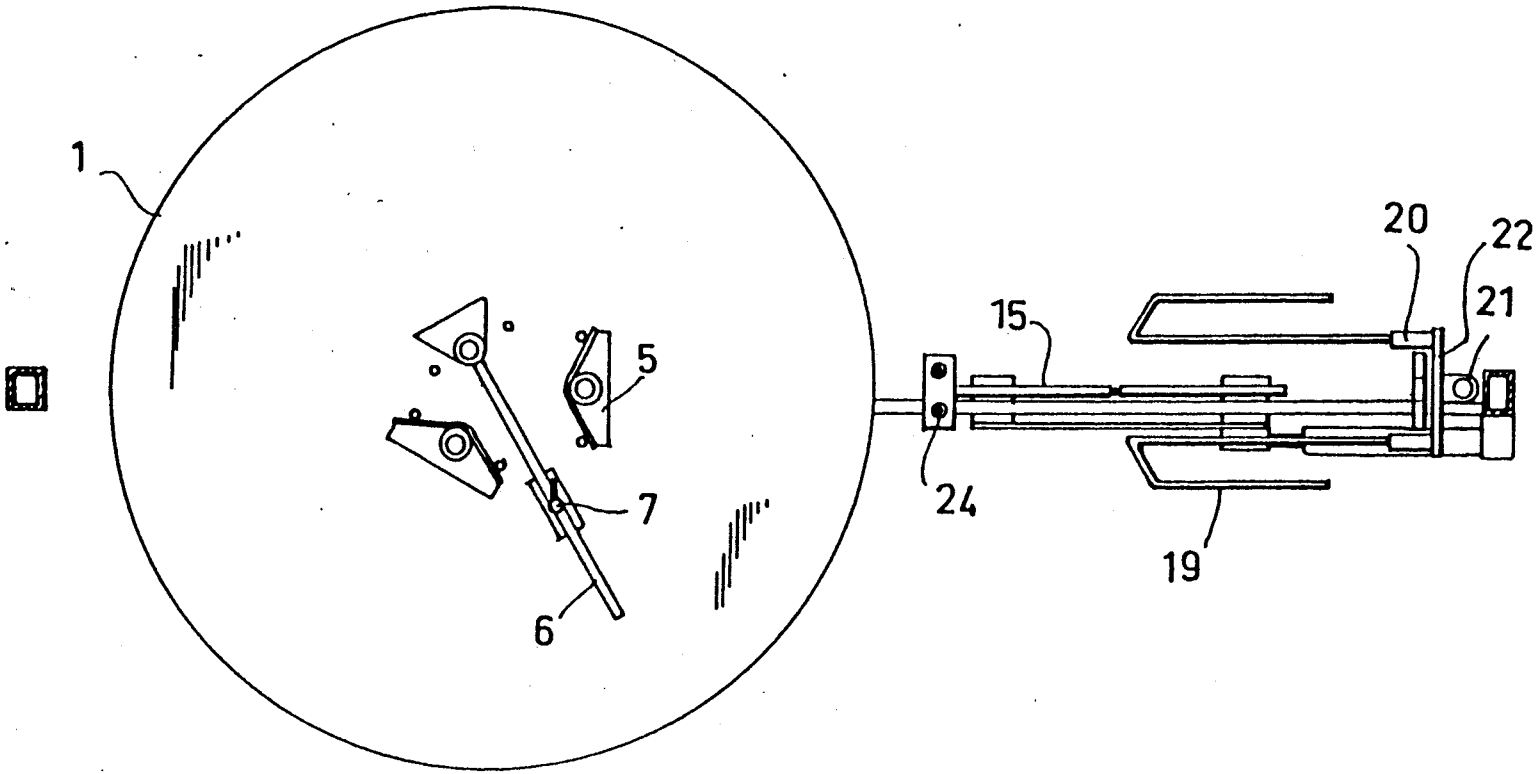
FIG. 4 is a longitudinal cross-sectional view along horizontal plane C—C of FIG. 1 and viewed in the direction of the arrows.

The machine shown in FIGS. 1 through 4 is intended to superimpose three flexible sheets such as a front panel, a rear panel and a gusset of a slip.

This machine comprises, firstly, a horizontal circular stack plate 1 resting through its lower face on three wheels 2 caused to rotate by means of a driving motor 3, and arranged on a support chassis 4.

This plate 1 includes holding and positioning members for the respective front, back and gusset stacks. These positioning members are arranged on the plate 1 is such a manner as to define between them angles of 120°, and are formed by ribs 5 near the center of the plate and guided vertically to assure by their weight the pinching of a longitudinal edge of the layers, for example the edge of each of these layers.

Additionally, at least one of these holding ribs 5 is provided with means for controlling its position and arranged to radially adjust this position on the stack plate 1. This controlling means comprises a scale arranged radially on the plate 1 and carrying carrying toward one of its extremities a rib 5, the scale comprising a longitudinal slot permitting adjustment of its position by means of a pressure screw 7 housed in the slot and adjusted through an opening provided in the plate 1.

In one embodiment which will be better understood hereinafter, the holding bars or ribs 5 for holding and positioning the stacks of gusset panels and front panels are arranged with a centrifugal displacement with respect to the ribs for holding the back panel stack.

The means 2, 3 for causing rotation of the plate 1 is adapted to cause it to turn one-third of a revolution at a time in such a manner as to successively bring each stack directly below a gripping assembly adapted to grasp one sheet from the stack.

The plate 1 is also subjected, after each third of a revolution, to a raising motion which lifts the stacks toward the gripping assembly and permits the latter to grip the upper sheet thereof.

To this end, the machine comprises a pneumatic cylinder or jack 8 arranged vertically and provided with a rod carrying near its end a horizontal support plate 9. From a retracted position where the horizontal support plate is situated a distance below the plate 1, the cylinder 8 is adapted to be deployed so that the support plate 9 comes into contact with the lower face of the plate 1, raising the plate 1.

Further, the upper face of the support plate 9 and the lower face of the plate 1 are provided with conjugate joining structures, adapted to assure the precise rotation and positioning of the plate. These joining structures comprise three female conical indentations 10 formed in the lower face of the plate 1, into which are introduced upon each displacement of the cylinder 8, conical projections 11 provided on the upper face of the support plate 9, which assures at the end of each rotation a precise position of the plate 1.

The gripping assembly itself comprises a frame 12, carried by a movable member 13*a* of a rodless pneumatic cylinder 13 arranged horizontally, and on which are mounted four aligned gripping heads 14, such as described in U.S. Pat. Nos. 4,635,918 and 4,822,020, and application for certificate of addition 88.06752.

This gripping assembly is caused to undergo a horizontal translational movement bringing it above a vertical plate 15 provided with an upper horizontal deposit edge arranged essentially in the same horizontal plane as the plate 1, in the raised gripping position of the plate 1.

This deposit plate 15 is supported by vertical feet 16 slidingly mounted along two horizontal guide bars 17 so as to permit a translational moving of this plate 15 toward and away from the plate 1. This translational movement is brought about by a pneumatic cylinder 18 arranged horizontally and the rod of which is fixed to the vertical feet 16 carrying the plate 15.

On opposite sides of the plate 15 and parallel to the upper edge thereof, are provided two deposit bars 19 which are subjected to a vertical reciprocating movement between a slightly elevated position with respect to the edge of the plate 15 and a lower retracted position. The deposit of each sheet is carried out on the deposit bars 19 in such a manner that the upper sheet of the superimposition does not displace the one or more sheets below, when it is brought above the deposit plate 15. The deposit bars 19 are then retracted after each deposit in order to allow the layer concerned to fall onto the deposit plate 15.

In order to obtain this reciprocating movement, the deposit bars 19 are carried by two holders 20 fixed to a movable member 21*a* of a rodless cylinder 21, vertically disposed. These two holders 20 are disposed on opposite sides of a vertical guide plate 22 provided with an upper portion on the longitudinal edges of which they are guided by a wheel 23. This guide plate 22, having an upper portion of greater width than its lower portion, permits during the ascending movement of the cylinder 21, to be subjected to a movement drawing nearer to the bars 19 such that these bars are positioned essentially side-by-side above the upper edge of the plate 15. By contrast, during the descending movement of the cylinder 21, the bars 19 separate from one another so as to deposit the layer across the upper layer of the plate 15 and to retract from this plate.

Fixed ahead of the plate 15, on the side of the rotating plate 1, are aspirating means comprising two nozzles 24 arranged on opposite sides of the plate 15. These nozzles 24 function to restrain the fabric of the layers passing thereby so as to suppress any risk of the appearance of undulations and to eliminate angular displacement or other positioning faults in the sheets with respect to the deposit plate 15.

Finally, two blowing nozzles 25 arranged above the plate 15 avoid undulations or folds appearing at the level of the points of the gussets or front panels when they are placed astride the plate.

The operation of this machine is described hereafter with reference to FIGS. 5*a* through 5*k*.

Figure 5A:
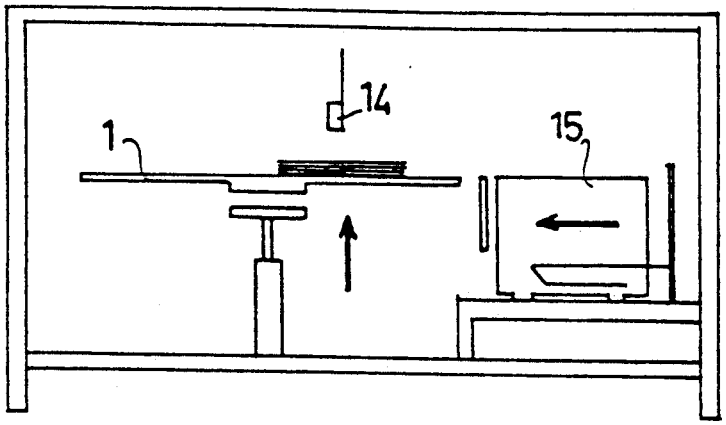
FIGS. 5*a* through 5*k* are schematic views illustrating the an operating cycle of the process and apparatus.

At the beginning of the cycle, the gripping assembly 12, 14 is positioned above the stack plate 1, directly over the stack of back panels (FIG. 5*a*). The deposit plate 15 is itself in the advanced position with regard to the plate 1, corresponding to an extended state of the cylinder 18.

Figure 5B:
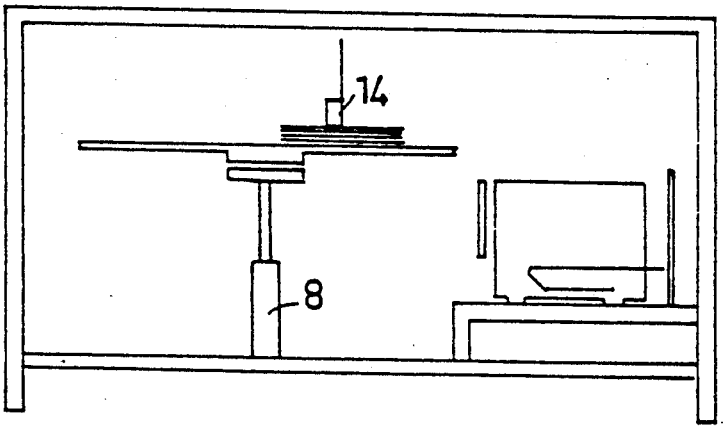

The cylinder 8 is then extended in such a manner that the upper layer of the stack of back panels contacts the grippers 14 and assures that this layer is picked up in the manner described in French patent No. 84.04804, French certificate of addition No. 86.02951 or the application for French certificate of addition No. 88.06752 (FIG. 5*b*). By reason of the radial displacement of this stack of back panels, the sheet is gripped along an intermediate line.

Figure 5C:
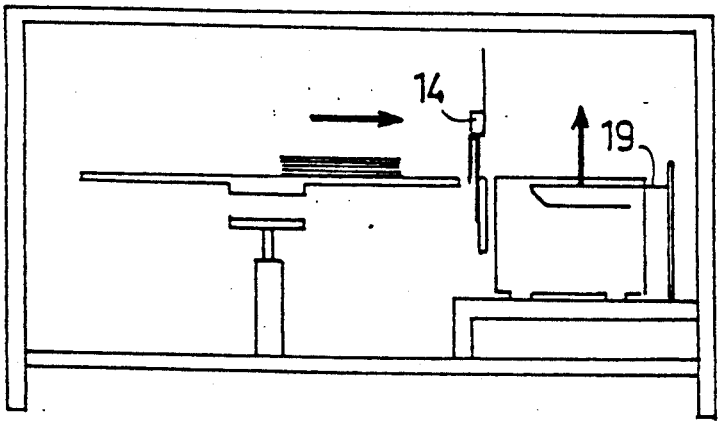

The gripping assembly 12, 14 is then caused to undergo a translational movement bringing it above the deposit plate 15, while the deposit bars 19 are brought to their slightly elevated position with respect to the upper edge of this plate (FIG. 5*c*).

Figure 5D:
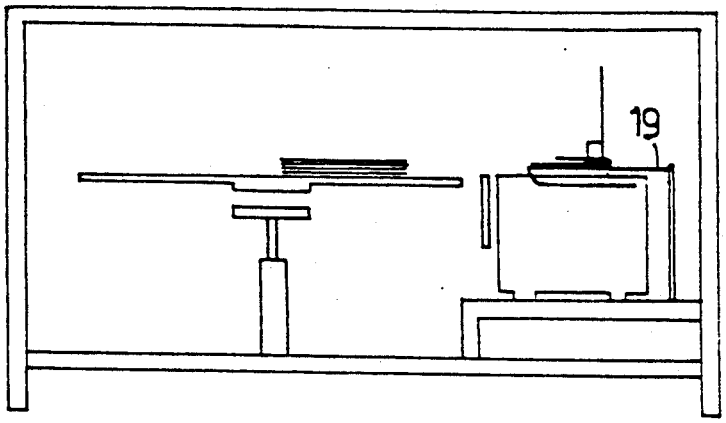
Figure 5E:
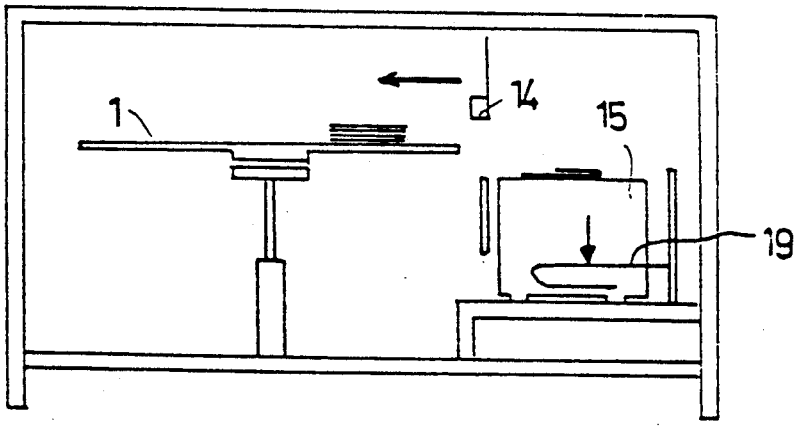

The grippers 14 are then actuated as described in French patent No. 84.04804, French certificate of addition No. 86.02951 or the application for French certificate of addition No. 88.06752, and the back panel is deposited astride the deposit bars 19, while being folded longitudinally on itself (FIG. 5*d*). The panel is then deposited on the deposit plate 15, followed by retraction of the deposit bars 19, while the gripping assembly 12, 14 is returned toward the plate 1 (FIG. 5*e*).

The rotating plate 1 is then caused to rotate onethird of a revolution, the cylinder 8 being retracted, in order to bring the front stack directly below the gripping assembly 12, 14, whereupon the cylinder 8 is extended in such a manner as to bring the upper layer of this stack into contact with the grippers 14. Contrary to the back panels, and by reason of the centrifugal displacement of this stack of front panels, the layer is then gripped along a line near its end.

Figure 5F:
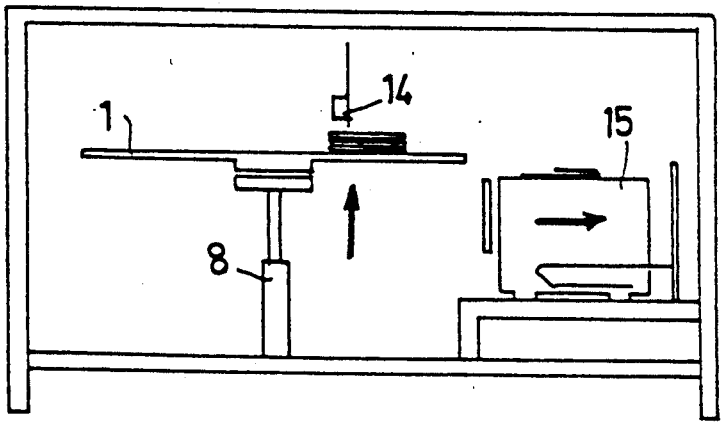
Figure 5G:
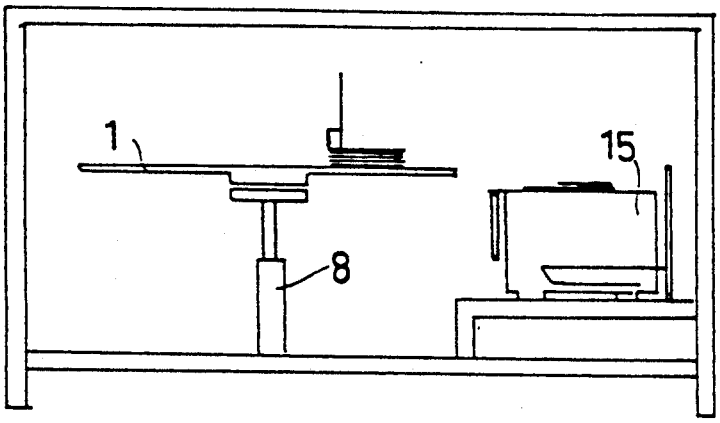
Figure 5H:
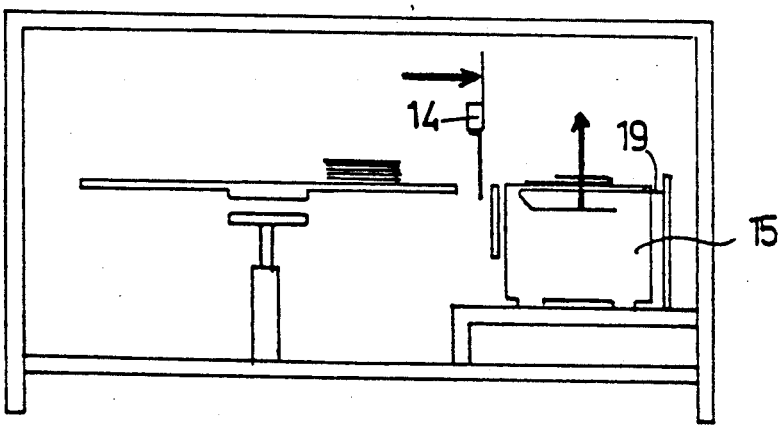

In a parallel manner, the deposit plate 15 is brought into its remote position with respect to the plate 1, corresponding to a retracted state of the cylinder 18 (FIGS. 5*f* and 5*g*).

Figure 5I:
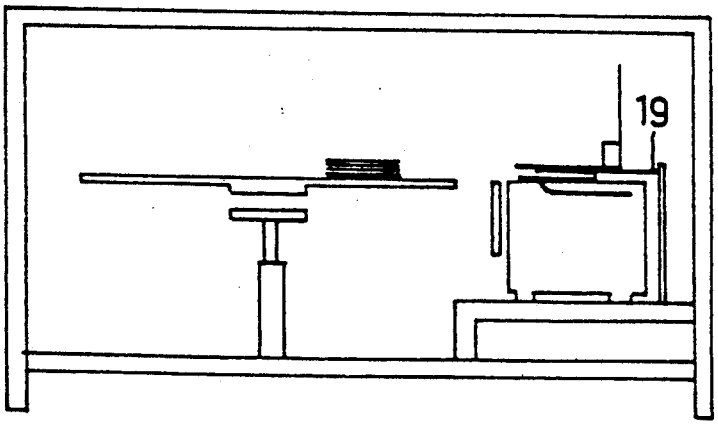

The gripping assembly 12, 14 is then brought once again above the deposit plate 15, while the deposit bars 19 are subjected to an ascending movement (FIG. 5*h*), and the front panel is deposited, extended astride the deposit bars 19, without longitudinal folding (FIG. 5*i*).

Figure 5J:
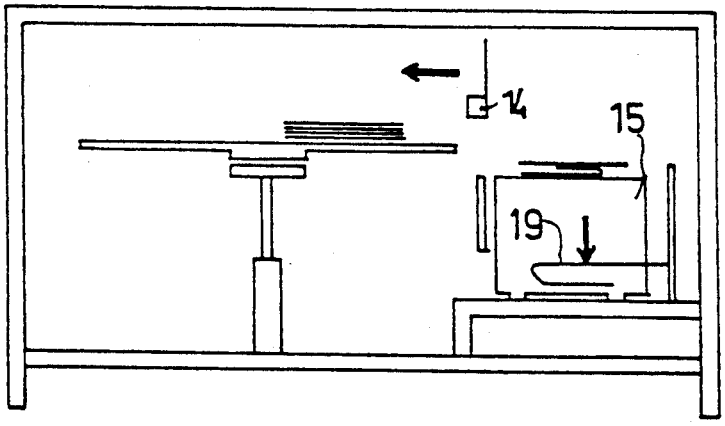

After retraction of the deposit bars 19, the front panel is extended on the deposit plate 15 without longitudinal folding (FIG. 5*j*). Further, this plate 15 is positioned more remote from the plate 1 than during the deposit of the back panel and the front and back panels are perfectly aligned.

Figure 5K:
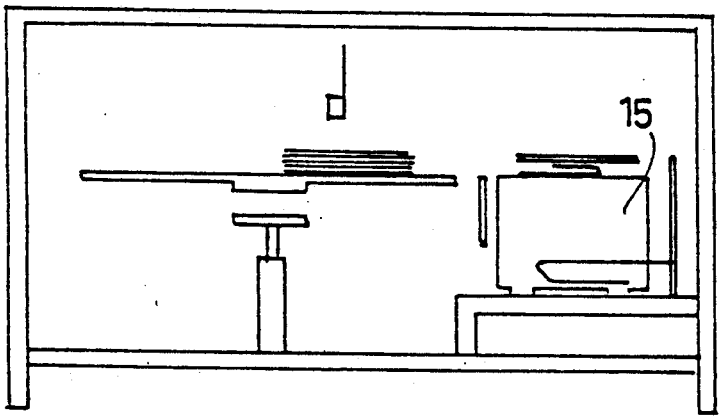

Finally, and in the same manner as for the front panels, the gripper assembly 12, 14 comes to grip a gusset panel and deposit it on the deposit plate 15 (FIG. 5*k*). The three sheets are then superimposed one on the other in an appropriate position to permit carrying out the sewing operation at once.

The operator may thus pick up the three layers and achieve on the same sewing machine first the sewing of the holding seam (axial sewing of the gusset), and then the two side seams. The folding of the back avoids the back being sewn when the gusset seam is sewn.

The time for carrying out these automatic preparatory operations is reduced by a factor of about 2.4 with respect to that necessary for carrying out the three conventional manual preparation operations mentioned earlier.

While this application has been described as having certain preferred features and embodiments, it will be understood that it is capable of still further variation and modification without departing from the spirit of the invention, and this application is intended to cover any and all variations, modifications and adaptations of the invention as fall within the spirit of the invention and the scope of the appended claims.

We claim:

1. A process for superimposing at least two flexible fabric sheets, said sheets comprising first and second panels of an article of clothing, said process comprising the steps of forming first and second stacks of said panels and placing said stacks on a stack plate (1), gripping at least one panel from a stack by means of a gripping assembly (12, 14), relatively displacing said stack plate and said gripping assembly between a rest position where said stack plate and said gripping assembly are separated a predetermined distance and a panel gripping position, subjecting the gripping assembly (12, 14) to a translation movement so as to bring the gripping assembly above a deposit member (15) comprising a vertical plate (15) having an upper horizontal deposit edge, and actuating said gripping assembly for releasing the panel and extending it onto said deposit member, returning the gripping assembly (12, 14) above said stack plate (1), rotating said stack plate a portion of a revolution so as to position a second stack directly below the gripping assembly, repeating the steps of gripping a panel, displacing the gripping assembly, subjecting the gripping assembly to a translation movement and actuating said gripping assembly for releasing said panel whereby a second panel is superimposed on the first panel on said deposit member.

2. A process as in claim 1, and including depositing said sheets initially onto two deposit bars (19) positioned on opposite sides of the deposit plate (15), parallel to the upper edge thereof, and displacing said bars between a position slightly elevated with respect to said upper edge and a lower retracted position.

3. A process as in claim 2, and including restraining the transported layer by aspiration in the vicinity of and ahead of the deposit member (15) in such a manner as to suppress any risk of undulation of said layer.

4. A process as in claim 3 for superimposing a back panel, a front panel and a gusset panel of a slip, and including arranging the stacks of gusset panels and front panels on the stack plate (1) angularly displaced with respect to the back panel stack in such a manner that the gripping assembly (12, 14) can grip each front panel and each gusset panel along a line near a longitudinal extremity thereof and each back panel along an intermediate line.

5. A process as in claim 4, and including subjecting the deposit member (15) to a translational movement toward and away from the plate (1) for adjusting the position of the deposit member and obtaining a superposition of the layers with their longitudinal edges aligned.

6. An apparatus for superimposing at least two flexible fabric sheets which comprise a front panel and a rear panel of an article of clothing, said apparatus comprising a stack plate (1) having means (5) for holding and positioning at least two stacks of sheets supported thereon, a deposit member comprising a vertical plate (15) having an upper horizontal deposit edge for the sheets, spaced from said stack plate, a gripping assembly (12, 14) for releasably gripping at least one sheet from a stack, translational displacement means (13) for said gripping assembly for displacing the same between a rest position above the plate (1) and a deposit position directly above the deposit member (15), means (8, 9) for relatively displacing said stack plate (1) and said gripping assembly (12, 14) and adapted to displace them between a position corresponding to said rest position of the gripping assembly (12, 14) and a position for picking up a layer, means (2, 3) for rotating said stack plate (1) and adapted to successively position the stacks thereon below the gripping assembly (12, 14) in said rest position.

7. An apparatus as in claim 6, said including two intermediate deposit bars (19) arranged on opposite sides of said deposit plate (15) and parallel to said upper deposit edge, and means (20-23) for displacing said bars between a position slightly elevated above said deposit edge of said vertical plate (15) and a lower retracted position.

8. An apparatus of claim 7 and including means (16, 17, 18) for translationally displacing said deposit member (15) relative to said plate (1), and adapted to control the distance between said plate and said deposit member.

9. An apparatus of claim 8, and including aspirating means (24) between said plate (1) and said deposit member (15) and near said deposit member (15) and adapted to restrain by aspiration the sheet transported by said gripping assembly (12, 14).

10. An apparatus as in claim 9, and including means (6, 7) for allowing movement of a positioning member (5) for said stacks of sheets, and adapted to radially adjust the placement of said stacks on the plate.

11. An apparatus as in claim 10, and wherein said means for relatively displacing said plate (1) and said gripping assembly (12, 14) comprises a vertically disposed cylinder (8) beneath said plate (1), said cylinder being provided with a rod carrying a support plate (9) adapted to come into contact with the plate upon extension of the cylinder so as to displace said plate to an upper, sheet gripping position.

12. An apparatus as in claim 11, and wherein said plate (1) and said support plate (9) include respectively a lower face and an upper face having abutting structures of conjugate forms, adapted to assure precise rotation of said plate.

* * * * *